US006742728B2

(12) United States Patent
Smith, III et al.

(10) Patent No.: US 6,742,728 B2
(45) Date of Patent: Jun. 1, 2004

(54) ELECTRICAL ACTUATOR SUBASSEMBLY WITH EXTERNAL THREADS AND FUEL INJECTOR USING SAME

(75) Inventors: Ralph A. Smith, III, Bloomington, IL (US); Gregory W. Hefler, Chillicothe, IL (US); Clifford E. Cotton, Pontiac, IL (US); Richard H. Holtman, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 104 days.

(21) Appl. No.: 09/927,815

(22) Filed: Aug. 10, 2001

(65) Prior Publication Data

US 2003/0029940 A1 Feb. 13, 2003

(51) Int. Cl.[7] ..... F02M 39/00; F02M 41/00; B05B 1/30

(52) U.S. Cl. ..... 239/585.1; 239/585.3; 239/585.4; 239/585.5; 239/533.3

(58) Field of Search ..... 239/585.1, 585.3, 239/585.4, 585.5, 533.2, 533.3, 533.7, 533.9, 88, 89, 90; 251/127, 129.15, 129.21, 129.18

(56) References Cited

U.S. PATENT DOCUMENTS

| | | | | |
|---|---|---|---|---|
| 5,141,164 A | * | 8/1992 | Ohno et al. | 239/585.2 |
| 5,465,910 A | * | 11/1995 | Hall et al. | 239/585.4 |
| 5,669,355 A | * | 9/1997 | Gibson et al. | 123/446 |
| 5,687,693 A | * | 11/1997 | Chen et al. | 123/446 |
| 5,927,614 A | * | 7/1999 | Touvelle et al. | 239/585.1 |
| 5,961,052 A | | 10/1999 | Coldren et al. | |
| 6,102,004 A | * | 8/2000 | Cowden et al. | 123/446 |

* cited by examiner

*Primary Examiner*—Davis Hwu
(74) *Attorney, Agent, or Firm*—Liell & McNeil

(57) ABSTRACT

An electrical actuator subassembly, preferably for use in a fuel injector, includes an externally threaded ferromagnetic metallic body, an internally threaded collar, an electrical actuator, an electrical connector, and a plastic cap. In one embodiment, the electrical actuator is a solenoid, while a piezoelectric actuator is used in a second embodiment. The electrical actuator directly controls a pilot valve member positioned between the metallic body and the injector body, and a needle valve which opens or closes a nozzle outlet at the bottom of the injector. The electrical actuator subassembly is attached to a fuel injector body by mating the external threads of the metallic body to the internal threads of the collar. The collar is attached to the injector body with a groove and snap ring configuration.

10 Claims, 3 Drawing Sheets

ELECTRICAL ACTUATOR SUBASSEMBLY WITH EXTERNAL THREADS AND FUEL INJECTOR USING SAME

TECHNICAL FIELD

The present invention relates generally to electrical actuator subassemblies, and more particularly to such subassemblies used in fuel injectors.

BACKGROUND

Many electronically-controlled fuel injectors use electrical actuators mounted on the outside of the injector body to control the initiation and termination of injection events. A common means of attaching the electrical actuator to the injector body is with three or more bolts, positioned beyond the periphery of the actuator's armature, which penetrate through the actuator and the injector body itself. As a result, the diameter of the injector body must be great enough to accommodate not only the armature, but also the bolts. The use of bolts not only creates a minimum diameter for the injector body, but the space taken up by the bolt holes creates limitations on the possible positioning of hydraulic lines and other components within the injector body. In addition to the benefits of conserving radial space, it is often necessary to position the injector underneath the engine valve cover, making conservation of vertical space desirable. Thus, in most examples of these fuel injectors, the electrical connector comes out of the side of the assembly rather than the top.

A threaded cap allows a lesser injector body diameter by obviating the need for bolts outside the periphery of the armature. One example of a design using a threaded cap and a top-mounted electrical connector can be found in U.S. Pat. No. 5,961,052, issued to Coldren et al. on Oct. 5, 1999. In the Coldren version, a cap with internal threads is mated directly to external threads on the injector body itself. This design has proven successful, however, the need to rotate the cap to tighten the assembly against the injector body would make the positioning of the electrical connector on the side of the injector difficult if not impossible.

The present invention is directed to solving one or more of the problems set forth above.

SUMMARY OF THE INVENTION

In one aspect, an electrical actuator subassembly is provided which has a metallic body with a set of external threads. Either a piezoelectric actuator or a solenoid coil is mounted in the metallic body.

In another aspect, a fuel injector is provided which includes an injector body, a collar with a set of internal threads attached to the injector body, and an electrical actuator subassembly including a metallic body with a set of external threads. In one embodiment, a piezoelectric actuator is mounted in the metallic body, whereas in a second embodiment a solenoid coil is used. The electrical actuator subassembly is mounted on the injector body by mating the subassembly's external threads with the collar's internal threads.

In still another aspect, a method of attaching an electrical actuator to a body component is provided. The method includes the steps of attaching a collar having a set of internal threads to a body component and providing an electrical actuator subassembly that includes a metallic body with a set of external threads. The method further includes mounting either a piezoelectric actuator or a solenoid coil in the metallic body and mating the external threads of the electrical actuator subassembly to the internal threads of the collar.

DETAILED DESCRIPTION

Figure 1:
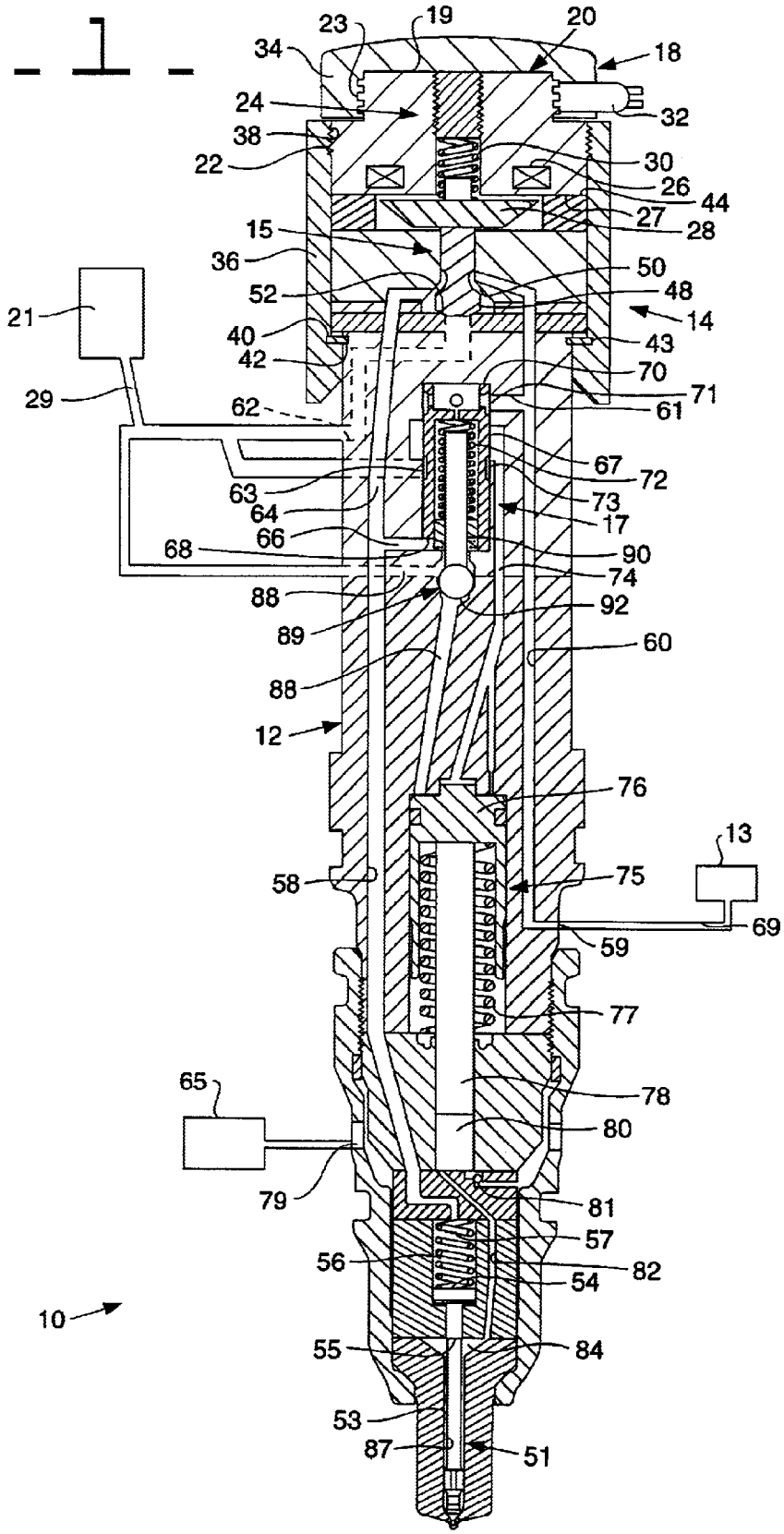
FIG. 1 is a diagrammatic sectioned side view of a fuel injector attached to an electrical actuator subassembly according to the present invention.

Referring to FIG. 1, there is shown a fuel injector 10 according to the present invention. Fuel injector 10 has an injector body 12 with a top 44 and a bottom 46. A control valve assembly 14 is provided which includes a pilot valve 15, a flow control valve 17, and an electrical actuator 24. Pilot valve 15 and flow control valve 17 are positioned within injector body 12, while electrical actuator 24 is positioned partly within an electrical actuator subassembly 18, and partly between subassembly 18 and injector body 12. Also positioned within injector body 12 is a fuel pressurization system 75, and a needle valve 51. A high pressure fluid source 13, a low pressure reservoir 21, and a common fuel rail 65 are also provided.

Figure 2:
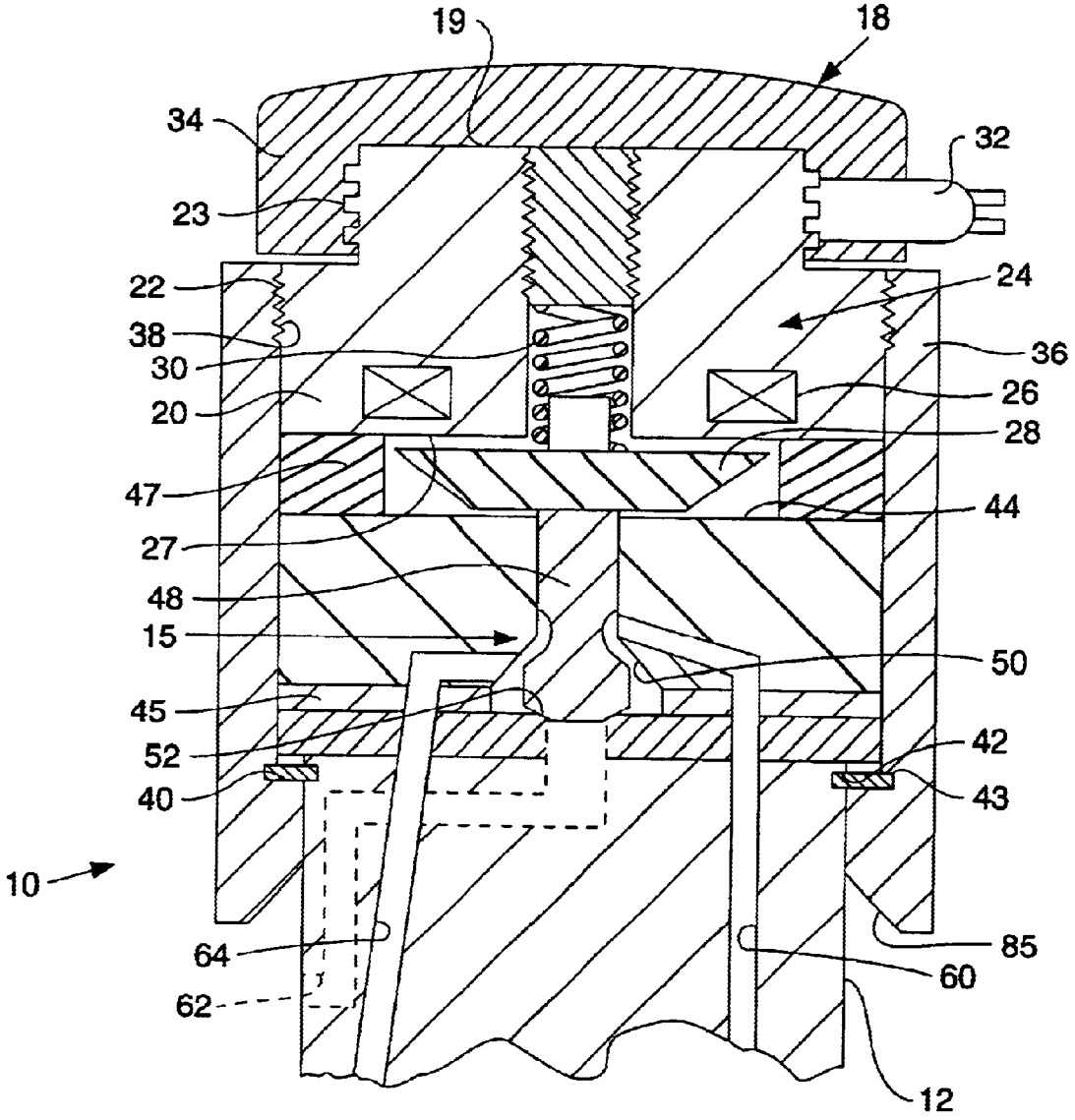
FIG. 2 is an enlarged partial diagrammatic side view of the fuel injector of FIG. 1 with an electrical actuator subassembly according to the present invention which provides a solenoid.

Referring in addition to FIG. 2, pilot valve 15 includes a valve member 48 which is movable between an up position in which it closes a high pressure seat 50, and a down position in which it closes a low pressure seat 52. Pilot valve 15 is illustrated as a poppet valve, though it should be appreciated that some other suitable valve type such as a ball and pin might be substituted. The movement of valve member 48 is controlled by energizing or de-energizing electrical actuator 24. Electrical actuator 24 has been illustrated as a solenoid which consists of a coil 26 and an armature 28 that is attached to valve member 48. A biasing spring 30 biases armature 28 and hence valve member 48 toward its down position when solenoid 24 is de-energized, as shown in FIG. 1.

Referring to FIG. 1, valve body 12 defines a high pressure passage 60, a pressure control passage 64, and a low pressure drain 62. High pressure passage 60 is fluidly connected to high pressure fluid source 13 via a high pressure supply line 69. Low pressure drain 62 is fluidly connected to low pressure reservoir 21 via low pressure line 29. When valve member 48 is in its down position, high pressure passage 60 is in fluid communication with pressure control passage 64. When valve member 48 moves toward its up position, high pressure passage 60 is closed to fluid communication with pressure control passage 64, and pressure control passage 64 is opened to fluid communication with low pressure drain 62. In the preferred embodiment, engine lubricating oil is used as the hydraulic fluid though it should be appreciated that fuel, transmission, power steering, or some other suitable engine fluid might be used.

The positioning of pilot valve 15 controls a flow control valve 17 that includes a valve member 67 which is movable between an up and a down position. Flow control valve 17 has been shown as a spool valve, though it should be appreciated that some other suitable valve type such as a poppet valve might be used. Valve member 67 has an upper hydraulic surface 70 and a control hydraulic surface 68 which preferably have substantially equal areas in the illustrated embodiment. A high pressure branch passage 61 supplies high pressure hydraulic fluid from high pressure passage 60 to valve member 67's upper hydraulic surface 70 via radial passages. A pressure control branch passage 66 which is fluidly connected to pressure control passage 64 provides either high or low pressure to valve member 67's control hydraulic surface 68, depending on the state of pilot valve 15.

When solenoid 24 is de-energized, and pilot valve member 48 is in its down position, high pressure hydraulic fluid is supplied to control hydraulic surface 68. Because high pressure is simultaneously acting on both of valve member 67's hydraulic surfaces, it is hydraulically balanced. A biasing spring 72 biases valve member 67 toward its up position, as shown. In this position, spool valve member 67 provides fluid communication via a low pressure annulus 73 between a low pressure passage 63, defined by valve body 12, and an actuation fluid passage 74, also defined by valve body 12.

When pilot valve 15 is in its up position, control hydraulic surface 68 is exposed to low pressure from pressure control passage 64 via pressure control passage branch 66. With low pressure acting on lower hydraulic surface 68, the high pressure in high pressure branch passage 61 overcomes the force of biasing spring 72 to move spool valve member 67 toward its down position. In its down position, spool valve member 67 provides fluid communication via a high pressure annulus 71 between high pressure branch passage 61 and actuation fluid passage 74 and ends fluid communication between actuation fluid passage 74 and low pressure passage 63 via low pressure annulus 73. The strength of biasing spring 72 should be great enough to move valve member 67 to its up position relatively quickly when valve member 67 is hydraulically balanced. However, the strength of biasing spring 67 should not be so great that the force on valve member 67's biasing hydraulic surface cannot move it to its down position when the valve member is not hydraulically balanced.

By appropriately positioning spool valve 17, actuation fluid passage 74 fluidly connects fuel pressurization system 75 to either high or low pressure hydraulic fluid. Fuel pressurization system 75 includes a piston 76 and plunger 78, which is movable between an up and a down position. When low pressure prevails in actuation fluid passage 74, a biasing spring 77 biases piston 76 and plunger 78 toward their up position. When high pressure is supplied to piston 76, it acts on plunger 78 to overcome the force of biasing spring 77 and drive plunger 78 toward its down position. As plunger 78 is driven toward its down position by piston 76, it pressurizes fuel in a fuel pressurization chamber 80. When plunger 78 moves back toward its up position by the force of biasing spring 77, fuel is drawn into fuel pressurization chamber 80 through a fuel inlet 79 and past a check valve 81. At the same time, used actuation fluid is evacuated above piston 76 to drain 63.

Fuel pressurization chamber 80 is fluidly connected via a nozzle supply line 82 with a nozzle chamber 84. Needle valve 51 includes a needle valve member 53 positioned partly within nozzle chamber 84, and is movable between a down/closed position and an up/open position. In its down position, as shown, needle valve member 53 blocks nozzle outlets 86 from a nozzle supply passage 87, prohibiting injection of fuel. When needle valve 53 is in its up position, nozzle outlets 86 are open and fuel can spray into the combustion space. Needle valve member 53 has a control hydraulic surface 54 which is exposed to fluid pressure in a needle control chamber 56. Needle control chamber 56 is fluidly connected via a needle control passage 58 to pressure control passage 64. Because pilot valve 15 controls the fluid pressure in pressure control passage 64, pilot valve 15 directly controls the pressure which acts on needle control hydraulic surface 54.

Needle valve member 53 also has an opening hydraulic surface 55 exposed to fluid pressure in nozzle chamber 84. In the preferred embodiment, direct control of needle valve 51 allows the pressure acting on control hydraulic surface 54 to be significantly reduced at the same time that fuel pressure in nozzle chamber 84 is dramatically increased by the action of plunger 80. As a result, hydraulic pressure acting on opening hydraulic surfaces 55 can force needle valve member 53 up, allowing pressurized fuel to spray out of nozzle outlets 86. However, the pressures and surfaces are sized such that needle 53 will remain at, or move toward, its downward closed position when high pressure exists in needle control chamber 56, even when fuel is pressurized to injection levels.

When injection is terminated, a biasing spring 56 and high pressure acting on control hydraulic surface 54 cooperate in moving needle valve member 53 back to its closed position relatively quickly. Between injection events, the force of biasing spring 56 and hydraulic pressure on control hydraulic surface 54 bias needle valve member 53 down to block nozzle outlets 86. A pressure relief passage 88 is defined by injector body 12 and is fluidly connected to piston 76. Excess pressure at the end of an injection event can be vented out passage 88 past a pressure relief valve 89 which consists of a ball 92 and pin 90 before spool valve 17 opens drain 63. This pressure relief valve 89 also improves opening response of spool valve 17.

Referring to FIG. 2, an electrical actuator subassembly 18 is shown which is located above the top 44 of injector body 12. Electrical actuator subassembly 18 provides a metallic body 20 with a set of external threads 22. Metallic body 20 has a side surface 23 extending between a top 19 and a bottom 27. Metallic body 20 acts as the stator for electrical actuator 24, and is thus preferably made from a suitable ferromagnetic material. Attached to metallic body 20 and covering a portion of the top 19 and side surface 23 is a plastic cap 34. Cap 34 is preferably composed of a thermal plastic that is injection molded with metallic body 20 and electrical connector 32 acting as the core for the mold. However, it should be appreciated that plastic cap 34 could be composed of any other suitable material, such as an electrical grade epoxy. An electrical connector 32 penetrates through plastic cap 34 and the side surface 23 of metallic body 20, and connects to an electrical actuator 24.

Electrical actuator subassembly 18 is mated to a collar 36 that has a set of matching internal threads 38 which are adjacent one end. Collar 36 is attached to metallic body 20 via a mating of internal threads 38 with external threads 22 of metallic body 20 at one end. A retention ledge 40 is adjacent the opposite end of collar 36. Injector body 12 also provides a retention ledge 42, which is oriented in opposition to retention ledge 40 of collar 36. A retention member 43, which is preferably a clip, is received in an annular groove on injector body 12 and has one side in contact with retention ledge 40, with the other side in contact with retention ledge 42. A ramp 85 is machined around the inside of this end of collar 36 which can slide the end of collar 36 past clip 43 to snap collar 36 into place on injector body 12.

Figure 3:
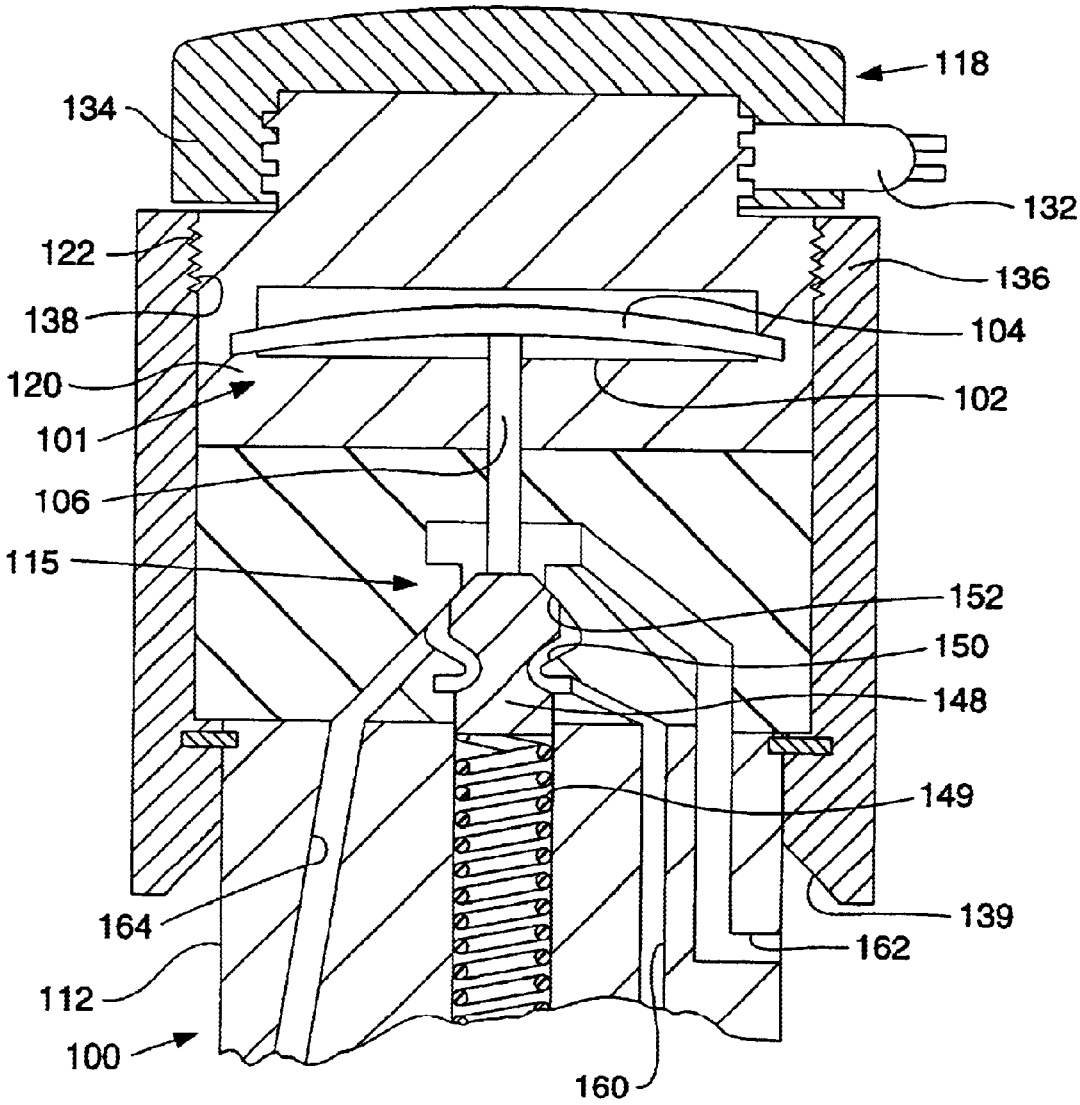
FIG. 3 is an enlarged partial diagrammatic side view of a fuel injector with an electrical actuator subassembly according to the present invention which provides a piezoelectric actuator.

Referring to FIG. 3, there is shown a partial side view of a fuel injector 100 representing a second embodiment of the present invention. It should be appreciated that these minor modifications to injector 10, those portions of injector 100 illustrated in FIG. 3 could be inserted into injector 10 to create a complete injector. Injector 100 is similar to injector 10, but employs a piezoelectric actuator 101 as the actuating mechanism for a pilot valve 115 rather than the solenoid disclosed for the FIGS. 1 and 2 embodiment. Injector 100 provides an electrical actuator subassembly 118 that includes a metallic body piece 120, piezoelectric actuator 101, and plastic cap 134. Cap 134 is preferably injection molded with metallic body 120 and an electrical connector 132 acting as the core for the mold. Electrical connector 132 can penetrate through plastic cap 34 and a side surface of metallic body 120, as shown, or through the top surface of metallic body 120. In addition, electrical connector 132 is in control communication with piezoelectric actuator 101. Subassembly 118 is attached to injector body 112 with a collar 136 that is substantially identical to collar 36 discussed previously. As with injector 10, metallic body piece 120 is attached to collar 136 via a mating of the external threads 122 of metallic body 120 with the internal threads 138 of collar 136. Housed within metallic body 120 is a piezoelectric bender encapsulation 102, inside of which is one or more piezoelectric benders 104.

Piezoelectric bender 104 can change shape by deforming in an axial direction from a first state in which it has a domed configuration, as illustrated in FIG. 3, to a second state in which it has a less domed configuration. The state of piezoelectric bender 104 influences the movement of a pilot valve member 148, which is mechanically coupled to piezoelectric bender 104 via a pin 106. When piezoelectric bender 104 is in its first state, such as when piezoelectric actuator 101 is de-energized, pilot valve member 148 is positioned in its upward, biased position under the action of a biasing spring 149. Pilot valve member 148 closes a low pressure seat 152 when in this upward position, such that a pressure communication passage 164 is fluidly connected to a high pressure passage 160. When piezoelectric bender 104 is in its second state, such as when piezoelectric actuator 101 is actuated, pilot valve member 148 is moved toward its downward position by pin 106, against the bias of biasing spring 149. Pilot valve member closes a high pressure seat 150 when in this downward position, such that pressure communication passage 164 is fluidly connected to a low pressure passage 162.

INDUSTRIAL APPLICABILITY

Referring to FIG. 2, there is shown a partial side view of fuel injector 10 from FIG. 1 with valve body 12 attached to electrical actuator subassembly 18 according to the present invention. Prior to attaching subassembly 18 to valve body 12, a lower seat component 52 should be positioned within valve body 12. A spacer 45 should then be positioned adjacent lower seat component 52. Valve member 48 should then be positioned at least partially within upper seat component 50. Upper seat component 50 should next be positioned adjacent spacer 45 and slid over the guide surface of valve member 48 such that valve member 48 is trapped between low pressure seat 52 and high pressure seat 50. A second spacer 47 should be positioned adjacent upper seat component 50 such that armature 28 may move up or down between the bottom 27 of metallic body piece 20 and the top 44 of injector body 12.

Electrical actuator subassembly 18 is attached to valve body 12 by mating metallic body 20's external threads 22 to the internal threads 38 of collar 36. The mating of external threads 22 with internal threads 38 is achieved by rotating collar 36 relative to metallic body 20, drawing metallic body 20 down toward the top 44 of injector body 12. Metallic body 20 is preferably composed of a ferromagnetic metal or metal alloy such that the magnetic field produced by an electrical current in solenoid coil 26 magnetizes metallic body 20 itself. In other words, metallic body 20 acts as the stator for the solenoid.

In the preferred embodiment, retention member 43 is connected to valve body 12, and collar 36 is pushed onto valve body 12 until retention surface 42 engages the retention member 43. In the preferred embodiment, a snap ring 43 mounted on valve body 12 serves as the retention member 43 used to connect valve body 12 to collar 36 and electrical actuator subassembly 18. Retention member 43 is preferably received in an annular groove on injector body 12, and a ramp 85, machined around the inside of collar 36, facilitates snapping collar 36 over clip 43 to engage retention ledges 40 and 42. It should be appreciated, however, that retention member 43 might be seated on collar 36 and a ramp machined on injector body 12 without departing from the scope of the present invention. An electrical connector 32 is provided and attached such that it protrudes through the top or the side surface 23 of metallic body 20 and through plastic cap 34. In the preferred embodiment, plastic cap 34 is produced in an injection molding process whereby metallic body 20 serves as the core, with liquid plastic injected into a mold around it. It should be appreciated, however, that some other method might be employed without departing from the scope of the present invention.

Returning to FIG. 1, when an injection event is desired, current to solenoid 24 is initiated. Armature 28 is drawn upward toward metallic body 20 and lifts valve member 48 to open low pressure seat 52 and close high pressure seat 50. Because pressure control passage 64 is fluidly connected to low pressure passage 62, spool valve member 48's lower hydraulic surface 68 is exposed to low pressure from pressure control branch passage 66. Because a constant high pressure is supplied via high pressure branch passage 61 to spool valve member 48's upper hydraulic surface 70, spool valve member 48 is no longer hydraulically balanced and can move against the force of biasing spring 72 toward its down position. As spool valve member 48 moves downward, high pressure annulus 71 fluidly connects actuation fluid passage 74 to high pressure passage 60. High pressure is thus supplied to piston 76, and it can move downward, driving plunger 78 down to pressurize fuel in fuel pressurization chamber 80. Because nozzle chamber 84 is fluidly connected to fuel pressurization chamber 80, the pressure in nozzle chamber 84 rises sharply, exerting an opening force on opening hydraulic surface 55.

When pilot valve member 48 is in this up position, needle control passage 58 is exposed to low pressure from low pressure passage 62 via pressure control passage 64. Needle closing hydraulic surface 54 is thus exposed to low pressure. Because the force biasing needle valve member 53 to block nozzle outlet 86 has dropped, the hydraulic force on opening hydraulic surface 55 can push needle valve member 53 away from nozzle outlet 86, allowing fuel to spray out when the fuel reaches a valve opening pressure.

Referring now to the FIG. 3 embodiment, valve body 112 and subassembly 118 are preferably attached by the same method as injector 10 and subassembly 18, illustrated in FIGS. 1 and 2. Rather than a solenoid electrical actuator, like the FIGS. 1 and 2 embodiment of the present invention, the embodiment shown in FIG. 3 employs a piezoelectric actuator. Between injection events, valve member 148 is held against low pressure seat 152 by biasing spring 149, allowing fluid communication between high pressure passage 160 and pressure control passage 164. When an injection event is desired, piezoelectric actuator 101 is actuated. Piezoelectric bender 104 bends, causing pin 106 to move valve member 148 toward its downward position to open low pressure seat 152 and close high pressure seat 150. Pressure control passage 164 is now fluidly connected to low pressure passage 162. When termination of injection is desired, piezoelectric actuator 101 is de-energized and piezoelectric bender 104 reverts to its first state. Valve member 148 is returned to its upward position by biasing spring 149, opening high pressure seat 150 and closing low pressure seat 152. As a result, high pressure once again prevails in pressure control passage 164.

The present invention conserves radial space by eliminating the need for bolts and bolt holes positioned outside the solenoid armature 28 or piezoelectric bender encapsulation 102. The present invention also potentially conserves vertical space because the electrical connectors can be mounted on the side rather than the top. Furthermore, the space in prior injectors which was taken up for bolt holes is now freed for hydraulic lines, other features, or a smaller package diameter. It should be appreciated that the present description is intended for illustrative purposes only and is not intended to limit the scope of the present invention in any way. Thus, those skilled in the art will appreciate that various modifications could be made to the disclosed embodiments without departing from the intended scope of the present invention. Other aspects and features of the present invention can be obtained from a study of the drawings, the disclosure, and the appended claims.

What is claimed is:

1. A fuel injector comprising:

an injector body with an annular retention surface;

a collar with an annular retention ledge oriented in opposition to said annular retention surface, and said collar including only a single set of internal threads;

an electrical actuator subassembly including a metallic body with a set of external threads, and at least one of a piezoelectric actuator component and a solenoid coil;

said electrical actuator subassembly being mounted on said injector body via a mating of said external threads with said internal threads;

said metallic body includes a side surface extending between a top surface and a bottom surface; and an electrical connection penetrating through at least one of said side surface and said top.

2. The fuel injector of claim 1 wherein said injector body includes a top and bottom; and said electrical actuator subassembly being located above said top.

3. A fuel injector comprising:

an injector body with a retention surface;

a collar with a retention ledge oriented in opposition to said retention surface, and said collar including a set of internal threads;

an electrical actuator subassembly including a metallic body with a set of external threads, and at least one of a piezoelectric actuator component and a solenoid coil;

said electrical actuator subassembly being mounted on said injector body via a mating of said external threads with said internal threads;

said injector body includes a top and bottom;

said electrical actuator subassembly being located above said top;

said metallic body includes a side surface extending between a top surface and a bottom surface;

an electrical connection penetrating through at least one of said side surface and said top; and a valve member positioned between a metallic body of said electrical actuator subassembly and said injector body, and being trapped between a high pressure seat and a low pressure seat.

4. A fuel injector comprising:

an injector body;

a collar with a set of internal threads attached to said injector body;

an electrical actuator subassembly including a metallic body with set of external threads, and at least one of a piezoelectric actuator component and a solenoid coil mounted in said metallic body;

said electrical actuator subassembly being mounted on said injector body via a mating of said external threads with said internal threads;

said injector body includes a top and bottom;

said electrical actuator subassembly being located above said top;

said metallic body includes a side surface extending between a top surface and a bottom surface;

an electrical connection penetrating through at least one of said side surface and said top;

a valve member positioned between said metallic body and said injector body, and being trapped between a high pressure seat and a low pressure seat;

said collar includes a first retention surface;

said injector body includes a second retention surface oriented in opposition to said first retention surface; and a clip having one side in contact with said first retention surface and an other side in contact with said second retention surface.

5. The fuel injector of claim 4 including a direct control needle valve with a closing hydraulic surface exposed to fluid pressure in a needle control passage; and said valve member is moveable between a first position in which said needle control passage is fluidly connected to a high pressure passage, and a second position in which said needle control passage is fluidly connected to a low pressure passage.

6. The fuel injector of claim 5 wherein said valve member is attached to an armature operably coupled to said solenoid coil; and said metallic body includes a solenoid stator.

7. A method of attaching an electrical actuator to a body component, comprising the steps of:

attaching a collar having a set of internal threads to a body component;

providing a electrical actuator subassembly that includes a metallic body with a set of external threads, and one of a piezoelectric actuator component and a solenoid coil mounted in said metallic body;

mating the external threads of the electrical actuator subassembly to the internal threads of the collar;

said mating step includes a step of rotating the collar relative to the body component;

said attaching step includes the steps of:

connecting a retention member to one of the collar and the body component; and pushing the collar onto the body component until a retention surface engages the retention member;

attaching a valve member to an armature; and positioning the armature between the body component and the electrical actuator subassembly before said mating step; and said connecting step includes a step of mounting a snap ring on the body component.

8. The method of claim 7 wherein said providing step includes a step of attaching an electrical connector to protrude through a side surface of the metallic body.

9. The method of claim 8 wherein said step of attaching a valve member is preceded by a step of positioning the valve member at least partially inside an upper seat component.

10. The method of claim 9 wherein said step of attaching the valve member is preceded by a step of positioning a lower seat component on the body component.

* * * * *

UNITED STATES PATENT AND TRADEMARK OFFICE

CERTIFICATE OF CORRECTION

PATENT NO. : 6,742,728 B2
DATED : June 1, 2004
INVENTOR(S) : Ralph A. Smith III et al.

It is certified that error appears in the above-identified patent and that said Letters Patent is hereby corrected as shown below:

Title page,
Item [56], References Cited, please add the following:
-- US 5,299,919 of 04/1994 Paul et al. --
-- US 5,722,373 of 03/1998 Paul et al. --

Signed and Sealed this

Tenth Day of August, 2004

JON W. DUDAS
*Acting Director of the United States Patent and Trademark Office*